US005864328A

United States Patent [19]

Kajimoto

[11] Patent Number: 5,864,328

[45] Date of Patent: Jan. 26, 1999

[54] DRIVING METHOD FOR A LIQUID CRYSTAL DISPLAY APPARATUS

[75] Inventor: Koichi Kajimoto, Tenri, Japan

[73] Assignee: Sharp Kabushiki Kaisha, Osaka, Japan

[21] Appl. No.: 705,824

[22] Filed: Aug. 30, 1996

[30] Foreign Application Priority Data

Sep. 1, 1995 [JP] Japan ..... 7-225433

[51] Int. Cl.[6] ..... G09G 3/18

[52] U.S. Cl. ..... 345/95; 345/210; 345/211; 345/89

[58] Field of Search ..... 345/87, 94, 95, 345/96, 98, 204, 208, 209, 210, 211, 212, 89, 90, 92

[56] References Cited

U.S. PATENT DOCUMENTS 5,229,761 7/1993 Fuse ..... 345/211
5,317,332 5/1994 Kanno et al. ..... 345/94
5,365,250 11/1994 Hiroshima ..... 345/94
5,627,556 5/1997 Kwan et al. ..... 345/211

FOREIGN PATENT DOCUMENTS 0479304 4/1992 European Pat. Off. ..... 345/211
5-323385 12/1993 Japan .

*Primary Examiner*—Lun-Yi Lao

[57] ABSTRACT

A driving method for LCD apparatuses allows the dividing-driving method, which is effectual against the residual image phenomenon, or the burning phenomenon, to be applicable to drivers which are provided in the conventional LCD apparatuses of the passive type and are driven by the voltage averaging method. By the method, among voltages inputted to the scanning electrode driving circuit, levels of voltages which are inputted also to the data electrode driving circuit are switched to different levels at fixed timings, while levels of voltages inputted only to the data electrode driving circuit are switched to different levels at fixed timings. With this, waveforms of the signals outputted by the respective driving circuits are adjusted, thereby resulting in that a waveform of a difference signal of the scanning signal and the data signal is adjusted.

6 Claims, 12 Drawing Sheets

DRIVING METHOD FOR A LIQUID CRYSTAL DISPLAY APPARATUS

FIELD OF THE INVENTION

The present invention relates to a method for driving a liquid crystal display apparatus provided with a matrix-type display panel wherein two-terminal non-linear elements are used as switching elements for pixels.

BACKGROUND OF THE INVENTION

In recent years, liquid crystal display apparatuses are widely used in a variety of fields, such as AV (Audio Visual) and OA (Office Automation) fields. In particular, LCD apparatuses of the passive type, which use TN (Twisted Nematic) or STN (Super Twisted Nematic) liquid crystal, are installed in low-end products. Further, LCD apparatuses of the active-matrix driving system are installed in high-end products. The LCD apparatuses of the active-matrix driving system use, as switching elements, TFTs (Thin Film Transistors), that is, three-terminal elements, MIM (Metal Insulator Metal) elements, that is, two-terminal non-linear elements (hereinafter referred to as two-terminal elements), or others.

The LCD apparatuses of the active-matrix driving system have features that are superior to those of CRTs (Cathode Ray Tubes) in color reproducibility, thinness, light-weight, and low power consumption, and the application of these displays has been rapidly expanding. However, LCD apparatuses using three-terminal elements such as TFTs as switching elements require thin-film forming processes and photolithography processes of 6–8 times or more during production of an LCD apparatus, resulting in high production costs. In contrast, LCD apparatuses using two-terminal elements such as MIM elements as switching elements, requiring less processes, are less expensive to produce compared with those using three-terminal elements, though display quality of the same is inferior to that of LCD apparatuses using three-terminal elements. In addition, LCD apparatuses using two-terminal elements also exhibit superior display quality compared with those of the passive type. Therefore, the use of the LCD apparatuses using two-terminal elements has been rapidly developing.

Furthermore, a voltage averaging driving method, which is a driving method for LCD apparatuses of the passive type, has an advantage that it can be adopted to LCD apparatuses using two-terminal elements. Therefore, the LCD apparatuses using two-terminal elements can realize high contrast and homogeneity in display.

As shown in FIG. 6, an LCD apparatus using the two-terminal elements has, for example, a display panel 61, a data electrode driving circuit 62, a scanning electrode driving circuit 63, and a control unit 64.

The display panel 61, as is the case with a usual LCD apparatus, includes data electrode lines X1 through Xn and scanning electrode lines Y1 through Ym, which are disposed in a matrix form. As shown in FIG. 7, a liquid crystal element 71 and a two-terminal element 72 such as MIM elements, which are connected in series with each other, are installed at each pixel, the pixels being formed by intersection of the data electrode lines X1 through Xn and the scanning electrode lines Y1 through Ym.

The data electrode driving circuit 62, which is usually composed of a shift resistor, a latch circuit, and an analog switch, etc. (not shown), is arranged so as to apply fixed voltages which correspond to display data, to the data electrode lines X1 through Xn provided in the display panel 61.

The scanning electrode driving circuit 63, which is usually composed of a liquid crystal driving power generating circuit, a shift register, and an analog switch, etc. (not shown), is arranged so as to apply fixed voltages in a line-sequential manner to the scanning electrode lines Y1 through Ym provided in the display panel 61.

The control unit 64 is equipped with a liquid crystal driving signal control section 65 and a liquid crystal driving voltage generating section 66. The control unit 64 is arranged so as to send control signals and liquid crystal driving voltages $V_0$ through $V_5$ to the data electrode driving circuit 62 and the scanning electrode driving circuit 63, so that inputted information is displayed in accordance with display data supplied from an input signal line 67.

The liquid crystal driving voltage generating section 66, as shown in FIG. 8, is arranged so as to produce electric potentials at 6 different levels, namely, electric potentials $V_0$ through $V_5$, using a voltage ($V_{EE}$) supplied by a liquid crystal driving power source 81, with a split resistor 82 and an operational amplifier (hereinafter referred to as OP amplifier) 83. The electric potentials $V_0$ through $V_5$ are sent as liquid crystal driving voltages $V_0$ through $V_5$ to voltage applying lines [$V_0$], [$V_1$], [$V_2$], [$V_3$], [$V_4$], and [$V_5$].

Among the voltage applying lines [$V_0$], [$V_1$], [$V_2$], [$V_3$], [$V_4$], and [$V_5$], as shown in FIG. 6, those [$V_0$], [$V_2$], [$V_3$], and [$V_5$] are arranged so as to supply voltages to the data electrode driving circuit 62, while the voltage applying lines [$V_0$], [$V_1$], [$V_4$], and [$V_5$] are arranged so as to supply voltages to the scanning electrode driving circuit 63.

The liquid crystal driving signal control section 65 is arranged so as to transmit, as control signals, a latch pulse LP (see FIG. 9(*a*)) and an AC conversion signal M (see FIG. 9(*b*)) to the data electrode driving circuit 62 and the scanning electrode driving circuit In accordance with the latch pulse LP as a control signal and the AC conversion signal M, fixed voltages (selected among the 6 liquid crystal driving voltages $V_0$ through $V_5$) are respectively applied to the scanning electrode lines Y1 through Ym and the data electrode lines X1 through Xn of the display panel 61 by the scanning electrode driving circuit 63 and the data electrode driving circuit 62.

For example, in the case where voltages represented by waveforms in FIGS. 9(*c*) and 9(*d*) are applied to a scanning electrode line Y1 and a data electrode line X1 respectively, a voltage represented by a waveform in FIG. 9(*e*) is applied to both ends of a pixel connected to the scanning electrode line Y1 and the data electrode line X1. Therefore, when a voltage represented by a solid line waveform shown in FIG. 9(*e*) is applied to the pixel connected to the scanning electrode line Y1 and the data electrode line X1, the liquid crystal element 71 is turned on, and when a voltage represented by a broken line waveform is applied, the liquid crystal element 71 is turned off.

Generally, the characteristic of the two-terminal element 72 is represented by an I-V (current versus voltage) characteristic that is indicated by a solid line 101 in FIG. 10. Note that the two-terminal element 72, when having a symmetrical characteristic, operates in the same manner irrelevant to the polarity. Therefore, only the case of the positive polarity is illustrated in the figure.

The I-V characteristic of the two-terminal element 72 exhibits a minute current with a high equivalent resistance when the applied voltage is low, while it exhibits an abruptly increased current with a low equivalent resistance when the applied voltage is high.

Accordingly, the two-terminal element 72 having this characteristic can be utilized in a displaying operation. More specifically, a high voltage which causes the two-terminal element 72 to have low resistance is applied to the two-terminal element 72, so that a voltage which turns on the liquid crystal element 71 is applied the liquid crystal element 71. In contrast, a low voltage which causes the two-terminal element 72 to have high resistance is applied to the two-terminal element 72, so that a voltage which turns off the liquid crystal element 71 is applied to the liquid crystal element 71.

Moreover, a voltage which has been applied to the liquid crystal element 71 during a selection period is maintained, since the two-terminal element 72 becomes high-resistive during a non-selection period. Therefore, it is possible to carry out a high-duty driving operation in a display using the two-terminal element 72, compared with a passive-type LCD apparatus.

Furthermore, the LCD apparatus using the two-terminal element 72 can be driven by using the voltage averaging method, whereby a voltage in a waveform shown in FIG. 11 is applied to a pixel, as is the case with a passive-type LCD apparatus. According to the voltage averaging method, a voltage represented by a solid line 111 is applied so that the liquid crystal element 71 is turned on, while a voltage represented by a broken line 112 is applied so that the liquid crystal element 71 is turned off. In short, the liquid crystal element 71 is turned on or off according to the level of the applied voltage during the selection period. Thus, an LCD apparatus driven by the voltage averaging method can ensure high contrast and homogeneity in display by setting a sufficiently big difference between voltages applied for turning on and off during the selection period.

Note that when DC (direct current) components are stored in the liquid crystal element 71, reliability of the liquid crystal element 71 is lowered. In order to avoid this, in general, the polarity of the applied voltage is reversed per frame (or per plural frames, or per plural lines). Therefore, the voltage in the waveform shown in FIG. 11, that is, the voltage applied to the liquid crystal element 71, has the positive and negative polarities alternately at certain intervals. In the following description, the case of the positive polarity is depicted for convenience sake.

When the LCD apparatus using the two-terminal element 72 is driven by the voltage averaging method, there arises a problem as follows: residual images (also referred to as burning) are liable to be produced due to affection of previous display, resulting from that an initial characteristic of the two-terminal element 72 rises.

Such a residual image phenomenon is caused as follows. For example, in an LCD apparatus in normally white mode (in this mode, black is displayed when the liquid crystal element 71 is turned on), as shown in FIG. 12(*a*), a pattern composed of a white center portion P1 and a black peripheral portion P2 is displayed on a display panel 121. When the display is changed from that having the above pattern to that wherein the whole screen is in gray, that is, in half tone, the pattern previously displayed remains, as shown in FIG. 12(*b*), causing the display to be inhomogeneous. To be more specific, some difference is caused in the display, between the central portion P1 previously in white and the peripheral portion P2 previously in black, thereby producing a residual image of the previously displayed pattern.

The residual image phenomenon stems from the voltage applying time-dependency of the I-V characteristic of the two-terminal element 72. To be more specific, as shown in FIG. 10, the I-V characteristic of the two-terminal element 72 is shifted from that indicated by a solid curved line 101 to that indicated by a broken curved line 102, as the application of the voltage is continued. Accordingly, as shown in FIG. 13, a V-T (voltage-transmittance) characteristic of the liquid crystal element 71 is also shifted from that indicated by a solid curved line 131 to that indicated by a broken curved line 132. In this case, a voltage whose transmittance is 50%, for example, is shifted from $V_{50}$ to $V_{50'}$ in the figure. Note that the shift amount depends on an applied voltage.

As shown in FIG. 14, the voltage shift amount $\Delta V$ ($=V_{50'}-V_{50}$) changes according to a voltage applying period. Moreover, the shift amount $\Delta V$ increases as the applied voltage becomes greater. Curved lines 141 and 142 indicate shift amounts $\Delta V$, when an applied voltage in the case of the solid curved line 141 is greater than that in the case of the broken curved line 142.

As is clear from the above description, when the pattern of FIG. 12(*a*) is displayed, a shift amount $\Delta V$ of the peripheral portion P2, to which a higher voltage is applied, is greater than that of the central portion P1. Therefore, when the display is switched from that having the pattern to the monotonous screen in grey which is half tone, namely, the same voltage is respectively applied to the central portion P1 and the peripheral portion P2, the peripheral portion P2 has a higher transmittance compared with the central portion P1 (see FIG. 13). Therefore, the residual image is produced as shown in FIG. 12(*b*).

Here, there has been proposed a driving method for driving an LCD apparatus, which can eliminate the influence of shift in the I-V characteristic of the two-terminal element on the display state, namely, which can suppress such a residual image phenomenon. The method can be realized by improving the manufacturing process and structure of the two-terminal element.

For example, Japanese Laid-Open Patent Publication No. 8-29748/1996 (Tokukaihei 8-29748) discloses a driving method for an LCD apparatus, wherein the selection period is divided into plural periods. By the method, the residual image phenomenon is reduced by applying a sufficient voltage during the first division of the selection period.

The following description will examine a case where the voltage averaging method, which ensures high contrast and homogeneous display, is adopted in combination with the driving method as described above (hereinafter referred to as dividing-driving method) whereby residual image phenomenon is suppressed by using the selection period divided into plural divisions.

According to the dividing-driving method, a scanning signal shown in FIG. 15(*c*) and a data signal shown in FIG. 15(*d*) are produced by selecting voltages out of the liquid crystal driving voltages $V_0$ through $V_5$ at six respective levels in accordance with a latch pulse LP shown in FIG. 15(*a*) and an AC conversion signal M shown in FIG. 15(*b*). In this case, a difference signal in accordance with a difference between the scanning signal and the data signal, that is, a driving voltage applied to a pixel (the liquid crystal), is either a turning-on voltage or a turning-off voltage in FIG. 15(*e*), the turning-on and turning-off voltages being represented by the solid line 151 and the broken line 152, respectively. Therefore, there arises a problem that it is difficult to control the driving voltage levels during the selection period, namely, to carry out the control so that a difference between the voltage levels when the liquid crystal is turned on and when it is turned off becomes sufficiently great during the selection period so as to make a high contrast.

With the described dividing-driving method, it is possible to suppress the residual image phenomenon, which stems from the voltage applying time-dependency of the I-V characteristic of the two-terminal element. However, it is difficult to control the driving voltage level during the selection period, and this makes it difficult to combine the dividing-driving method with the voltage averaging method wherein whether the liquid crystal is turned on or off is determined according to the levels of the applied voltage during the selection period.

Moreover, in order to adopt the voltage averaging method to an LCD apparatus of the active matrix driving system driven by the dividing-driving method, it is required to develop new-type drivers for use in such an LCD apparatus, namely, drivers being able to adjust waveforms of voltages outputted therefrom. However, this requires a period of time for developing such drivers, and leads to a rise in the cost of the liquid crystal device.

SUMMARY OF THE INVENTION

The object of the present invention is to provide a method for driving an LCD apparatus of the active matrix driving system, which allows the dividing-driving method to be applied to a driving circuit (driver) driven by the voltage averaging method. The dividing-driving method is applied to an LCD apparatus using a two-terminal element and is effectual against the residual image phenomenon, or the burning phenomenon, while the voltage averaging method is applied to a conventional LCD apparatus of the passive type.

To achieve the above object, the method for driving an LCD apparatus of the present invention, the LCD apparatus comprising a scanning electrode group, a data electrode group, liquid crystal elements, and two-terminal non-linear elements, each of intersections of the scanning electrodes and the data electrodes having one of the liquid crystal elements and one of the two-terminal non-linear elements, the liquid crystal element and the two-terminal non-linear element being connected in series each other and connected to the scanning electrode and the data electrode composing the intersection, the method comprising:

a first step of switching levels of driving voltages at respective fixed timings in each division period of selection periods, each selection period being for selecting one scanning electrode in the scanning electrode group and being divided into at least two division periods, the driving voltages being a plurality of driving voltages in a first driving voltage group and a plurality of driving voltages in a second driving voltage group, the combination of driving voltages in the second driving voltage group being different from that of the first driving voltage group;

a second step of generating a scanning signal and a data signal, the scanning signal being generated by a scanning electrode driving circuit in accordance with the first driving voltage group and applied to the scanning electrodes in a line-sequential manner so that one scanning electrode is selected during each selection period, the data signal being generated by a data electrode driving circuit in accordance with the second driving voltage group and applied to each data electrode of the data electrode group; and a third step of applying a voltage to liquid crystal elements connected to the selected scanning electrode and the data electrodes through the intermediary of two-terminal non-linear elements connected to the liquid crystal elements in series, so as to drive the liquid crystal elements, by applying the scanning signal to the selected scanning electrode while applying the data signal to the data electrode group.

According to the above-described method, the levels of the respective voltages applied to the scanning electrode driving circuit and the data electrode driving circuit are changed at fixed timings. Therefore, the waveforms of the respective signals outputted by the foregoing driving circuits are adjusted in accordance with the levels of the voltages applied to the driving circuits, at every division period of the selection period. As a result, the waveform of the difference signal in accordance with a difference between the scanning signal and the data signal is adjusted at every division period of the selection period. This allows the first division periods of the selection periods to be used as writing periods while the division periods coming after the writing periods in the selection periods to be used as erasing periods, so that the difference signals applied during the writing periods are cancelled with voltages applied during the erasing periods. As a result, it is possible to prevent the residual image phenomenon, or the burning phenomenon, which stems from the voltage applying time-dependency of the I-V characteristic of the two-terminal non-linear element. In other words, it is possible to drive the LCD apparatuses by the dividing-driving method, whereby each selection period is divided into a plurality of division periods and voltages of different levels are respectively applied in the division periods.

Furthermore, since the waveform of the difference signal obtained from the scanning signal and the data signal outputted by the respective driving circuits is adjusted by switching the levels of the voltages supplied to the driving circuits, conventional driving circuits can be used without revision. In other words, the dividing-driving method, which is effectual against residual images, or burnings, of the LCD apparatuses incorporating the two-terminal non-linear elements, is applicable to the driving circuits adopted in the conventional LCD apparatuses of the passive type. Thus, the dividing-driving method is applicable to the driving circuits (drivers) driven by the voltage averaging method, which are employed in the conventional LCD apparatuses of the passive type.

Since it is thus possible to utilize the conventional drivers of the LCD apparatuses, it is not necessary to develop new dividing-driving method-use drivers. Besides, the adjustment of voltages supplied to the drivers is enabled only by giving a small change to a driving voltage generating circuit. Therefore, it is also possible to suppress a rise in the cost of the LCD apparatuses. It is also possible to shorten a period required for developing a new LCD apparatus with a higher display quality.

For a fuller understanding of the nature and advantages of the invention, reference should be made to the ensuing detailed description taken in conjunction with the accompanying drawings.

DESCRIPTION OF THE PREFERRED EMBODIMENTS

The following description will discuss an embodiment of the present invention, referring to FIGS. 1 through 5 and 7. Note that in the present embodiment, a driving method wherein the selection period is divided into two is adopted as the driving method of an LCD apparatus.

Figure 1:
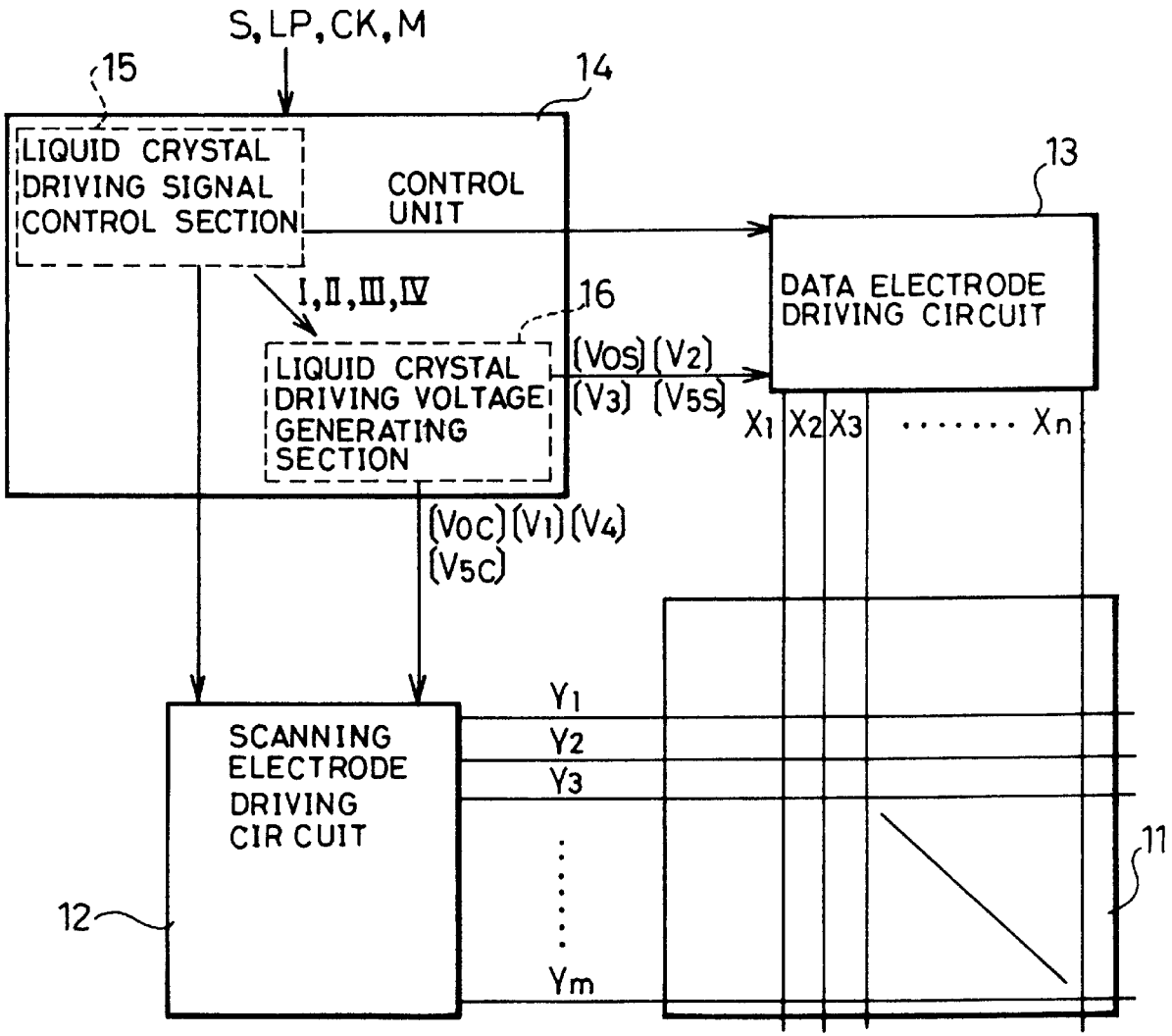
FIG. 1 is a block diagram illustrating a schematic arrangement of an LCD apparatus to which the method for driving an LCD apparatus of the present invention is applied.

An LCD apparatus of the present embodiment includes a display panel 11, a scanning electrode driving circuit 12, a data electrode driving circuit 13, and a control unit 14, as shown in FIG. 1.

Figure 7:
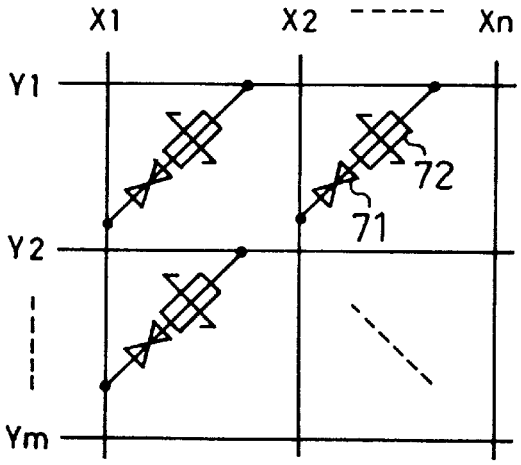
FIG. 7 PRIOR ART
FIG. 7 is a circuit diagram illustrating a pixel provided in the LCD apparatus shown in FIG. 6.
Figure 8:
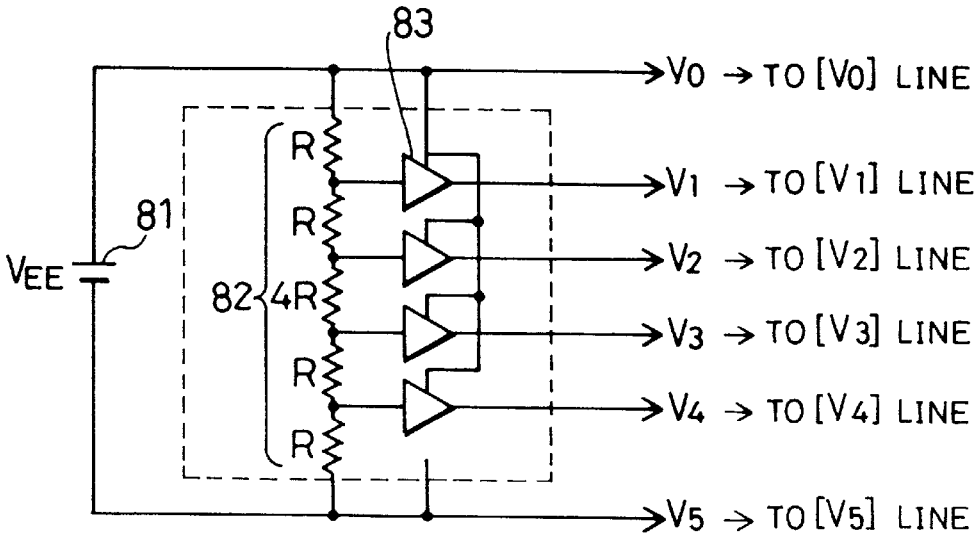
FIG. 8 PRIOR ART
FIG. 8 is a circuit diagram illustrating a schematic arrangement of a liquid crystal driving voltage generating section provided in the LCD apparatus shown in FIG. 6.
Figure 9:
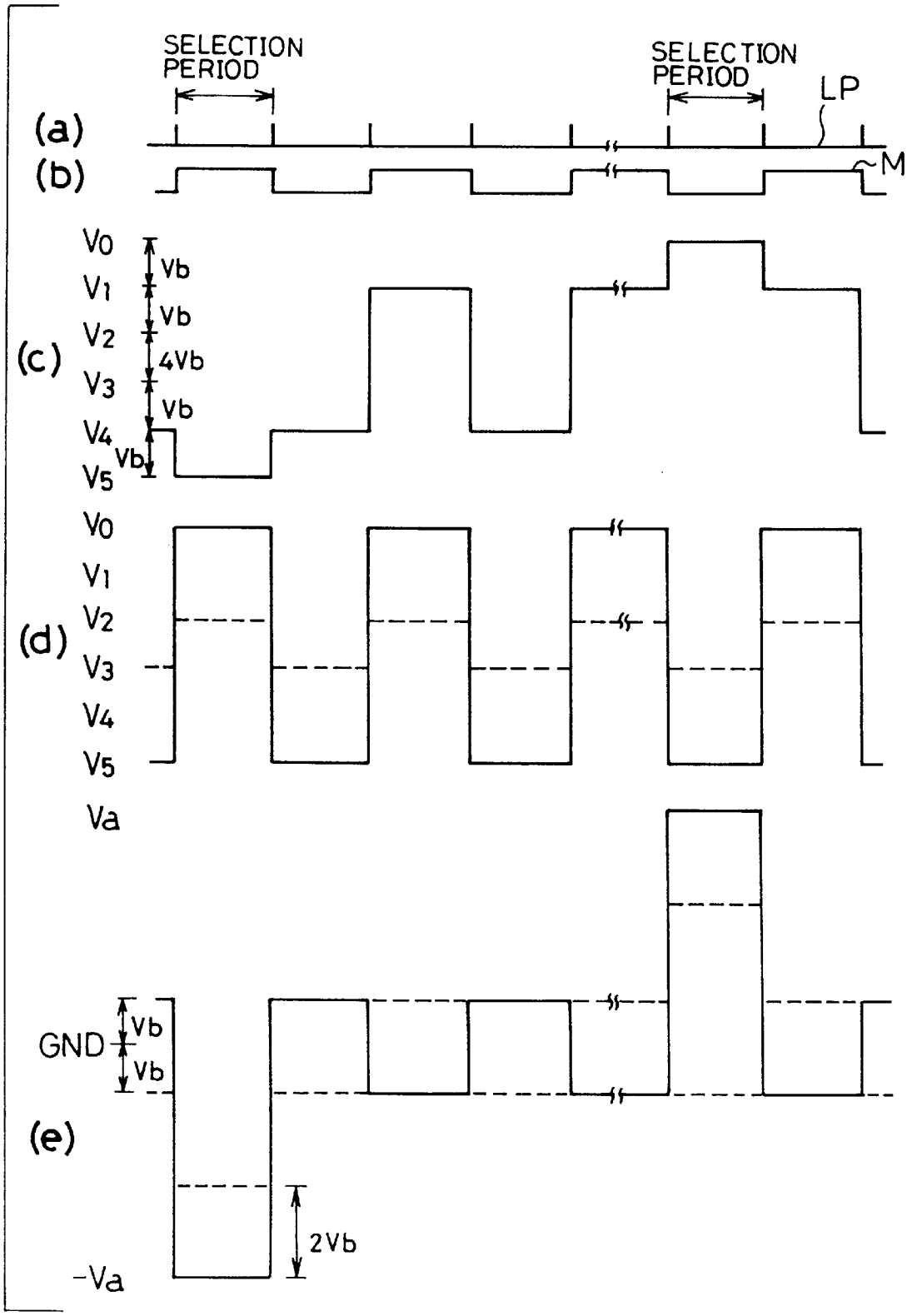
FIG. 9 PRIOR ART
FIG. 9 is a view illustrating signal waveforms relating to a method for driving the LCD apparatus shown in FIG. 6.
Figure 10:
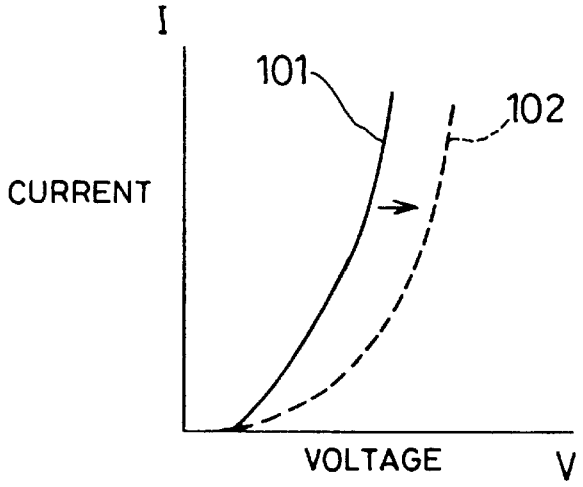
FIG.10 PRIOR ART
FIG. 10 is a graph illustrating the I-V characteristic of a two-terminal non-linear element.
Figure 11:
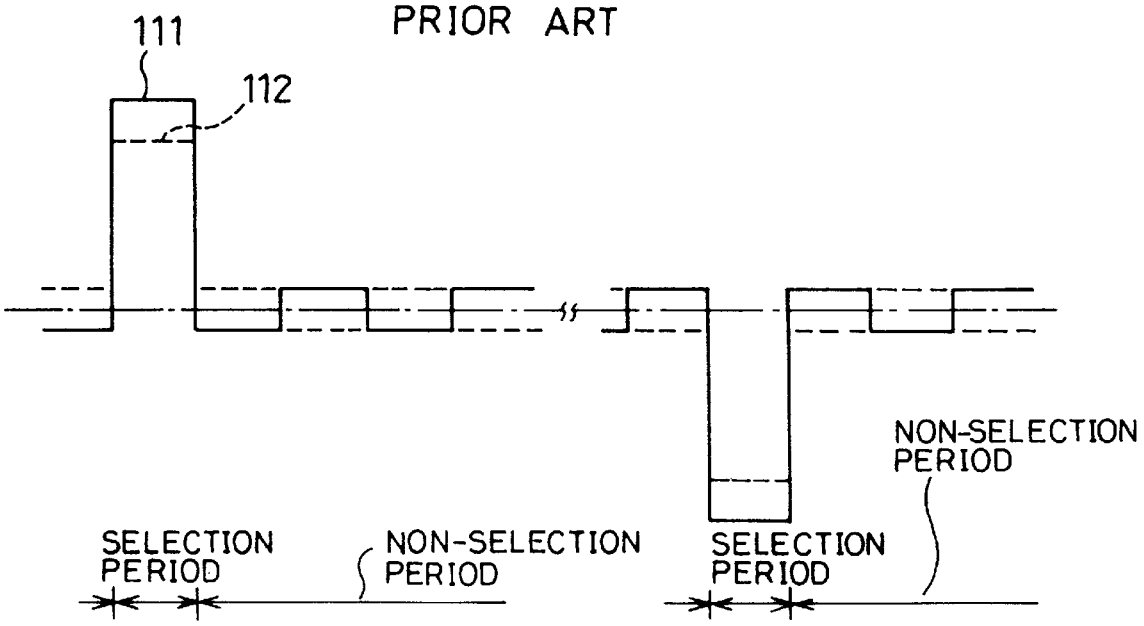
FIG.11 PRIOR ART
FIG. 11 is a view illustrating waveforms in the case where an LCD apparatus of the active matrix type utilizing the two-terminal non-linear elements is driven by the voltage averaging method.
Figure 12A:
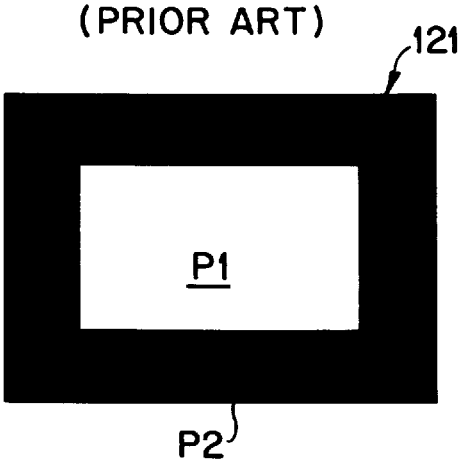
FIG. 12(a) (PRIOR ART)
FIGS. 12(*a*) and 12(*b*) are views illustrating the residual image phenomenon occurring to an LCD apparatus in normally white mode, FIG. 12(*a*) illustrating an original image, FIG. 12(*b*) illustrating an image with a residual image.
Figure 12B:
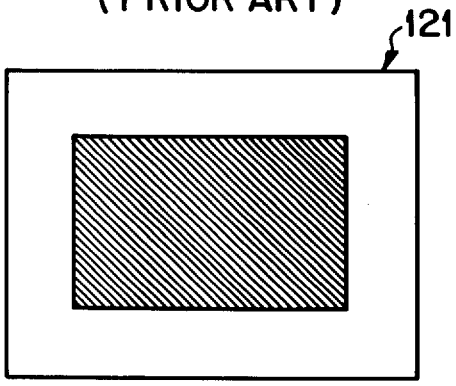
FIG. 12(b) (PRIOR ART)
Figure 13:
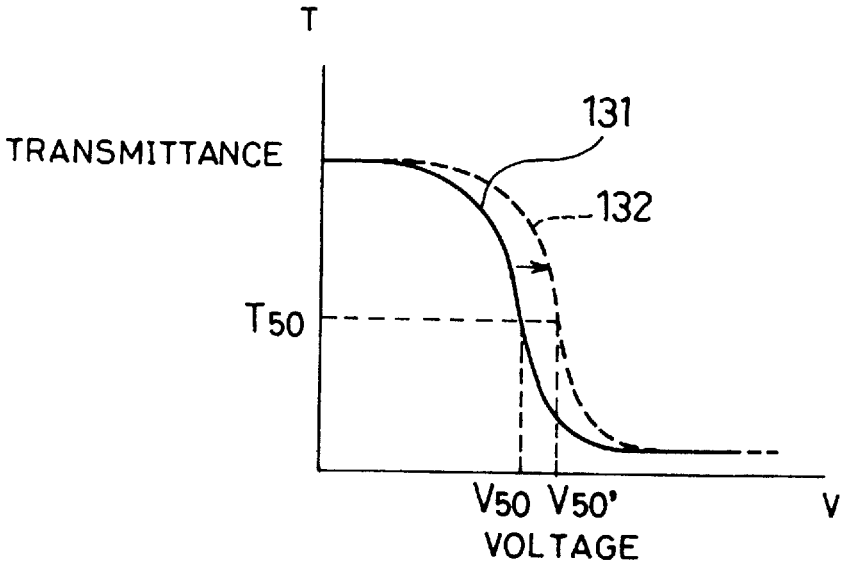
FIG. 13 is a graph illustrating the T-V (transmittance-voltage) characteristic of the liquid crystal.
Figure 14:
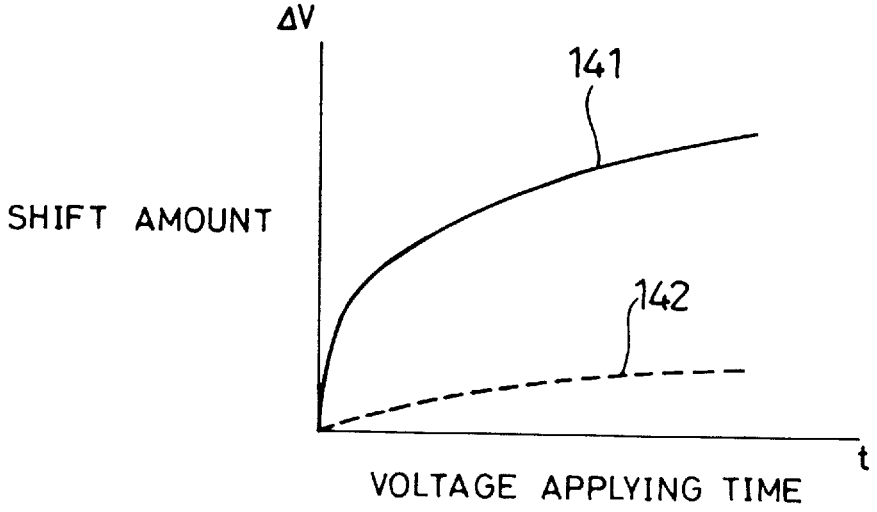
FIG. 14 is a graph illustrating voltage applying time-dependency of shift amounts of voltages with a transmittance of 50 percent.
Figure 15:
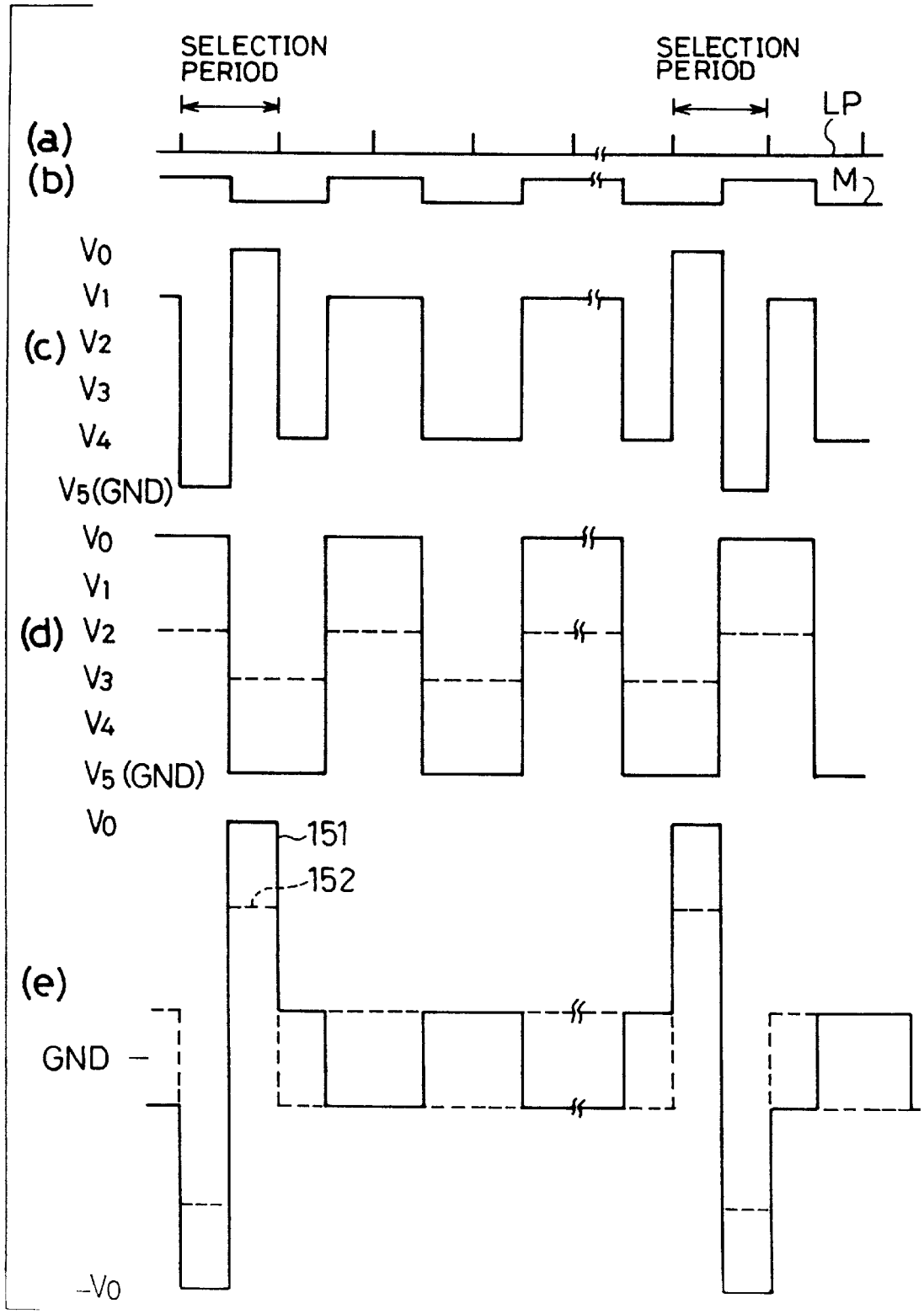
FIG.15 PRIOR ART
FIG. 15 is a view illustrating waveforms in the case where the LCD apparatus using two-terminal non-linear elements, which is driven by the dividing-driving method whereby voltages at different levels are respectively applied in the first and latter halves of each selection period, is further driven by the voltage averaging method.

The display panel 11 has data electrode lines X1 through Xn and scanning electrode lines Y1 through Ym, and each intersection of the data electrode lines X1 through Xn and the scanning electrode lines Y1 through Ym forms a pixel. Each pixel has a liquid crystal element 71 and a two-terminal non-linear element (hereinafter referred to as two-terminal element) 72, as shown in FIG. 7.

The scanning electrode driving circuit 12, which usually includes a liquid crystal driving power generating circuit, a shift register, and an analog switch, etc. (not shown), is arranged so as to apply fixed voltages in a line-sequential manner to the scanning electrode lines Y1 through Ym provided in the display panel 11.

The data electrode driving circuit 13, which usually includes a shift resistor, a latch circuit, and an analog switch, etc. (not shown), is arranged so as to apply fixed voltages in accordance with display data, to the data electrode lines X1 through Xn provided in the display panel 11.

The control unit 14 is equipped with a liquid crystal driving signal control section 15 and a liquid crystal driving voltage generating section 16. Control signals sent from outside, such as a scanning start signal S, a data latch signal LP, a data shift signal CK, and a switch signal M, are inputted to the control unit 14.

In response to control signals of various types inputted to the control unit 14, the liquid crystal driving signal control section 15 sends control signals to the scanning electrode driving circuit 12 and the data electrode driving circuit 13, which are driving circuits for the scanning electrode lines Y1 through Ym and for the data electrode lines X1 through Xn, respectively. Besides the control signals, the liquid crystal driving signal control section 15 also sends switching control signals I through IV (described below) to the liquid crystal driving voltage generating section 16.

The liquid crystal driving voltage generating section 16 is arranged so as to output liquid crystal driving voltages $V_p$, $V_1$, $V_4$, and $V_N$ to the scanning electrode driving circuit 12 through voltage applying lines $[V_{0C}]$, $[V_1]$, $[V_4]$, and $[V_{5C}]$, while it is also arranged so as to output liquid crystal driving voltages $V_0$, $V_2$, $V_3$, and $V_5$ to the data electrode driving circuit 13 through voltage applying lines $[V_{0S}]$, $[V_2]$, $[V_3]$, and $[V_{5S}]$.

Figure 2:
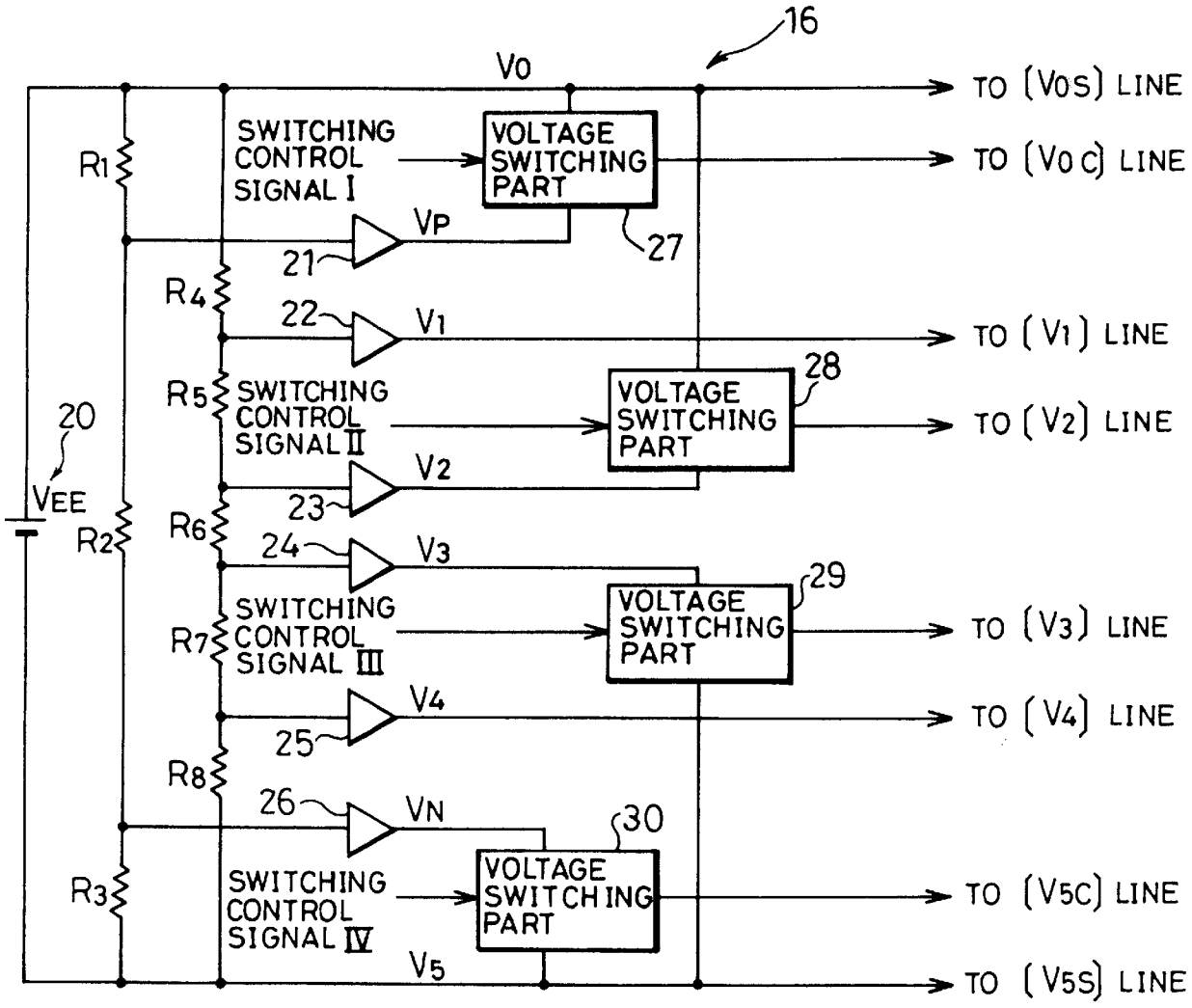
FIG. 2 is a schematic circuit diagram illustrating a liquid crystal driving voltage generating section provided in a control circuit of the LCD apparatus shown in FIG. 1.

As shown in FIG. 2, the liquid crystal driving voltage generating section 16 includes, for example, a power source 20 for generating a liquid crystal driving power source voltage $V_{EE}$, split resistors R1 through R8, six operational amplifiers (hereinafter referred to as OP amplifiers) 21 through 26, and four voltage switching parts 27 through 30, so as to produce electric potentials at 8 levels.

The split resistors R1 through R3 are connected in series, and the split resistor R1 is connected to a point on a line between the power source 20 and the line $[V_{0S}]$ while the split resistor R3 is connected to a point on a line between the power source 20 and the line $[V_{5S}]$. The OP amplifier 21 is connected to a point on the line between the split resistor R1 and R2 while the OP amplifier 26 is connected to a point on the line between the split resistors R2 and R3, so that the liquid crystal driving power source voltage $V_{EE}$ is divided into electric potentials $V_P$ and $V_N$ through the OP amplifiers 21 and 26.

On the other hand, as is the case with the split resistors R1 through R3, the split resistors R4 through RB are connected in series, so that the high power source electric potential $V_0$ is applied to the split resistor R4 while the low power source electric potential $V_5$ to the split resistor R8. The OP amplifier 22 is connected to a point on the line between the split resistors R4 and R5, the OP amplifier 23 to a point on the line between the split resistors R5 and R6, the OP amplifier 24 to a point on the line between the split resistors R6 and R7, and the OP amplifier 25 to a point on the line between the split resistors R7 and R8, so that the liquid crystal driving power source voltage $V_{EE}$ is divided into electric potentials $V_1$ through $V_4$, through the OP amplifiers 22 through 25.

The output terminals of the OP amplifiers 21, 23, 24, and 26 are connected to the voltage switching parts 27 through 30, respectively. With this arrangement, the voltage switching parts 27 and 30 switch voltages supplied to the scanning voltage applying lines $[V_{0C}]$ and $[V_{5C}]$, from the high power source electric potential $V_0$ and the low power source electric potential $V_5$ of the liquid crystal driving power source voltage $V_{EE}$, to the electric potentials $V_P$ and $V_N$ obtained by the OP amplifiers 21 and 26, respectively.

Likewise, the voltage switching parts 28 and 29 switch voltages supplied to the scanning voltage applying lines [$V_2$] and [$V_3$], from the high power source electric potential $V_0$ and the low power source electric potential $V_5$ of the liquid crystal driving power source voltage $V_{EE}$, to the electric potentials $V_2$ and $V_3$ obtained by the OP amplifiers 23 and 24, respectively. The switching of voltages by the voltage switching parts 27 through 30 is carried out in response to the above-mentioned switching control signals I through IV.

The values of resistance $R_1$, $R_2$, and $R_3$ of the resistors R1 through R3 satisfy a relation given as:

$R_1=R_3\neq R_2$

The values of resistance R4 through R8 satisfy a relation given as:

$R_4=R_5=R_7=R_8\neq R_6$ wherein $R_6$ is four times greater than $R_4$.

Figure 3:
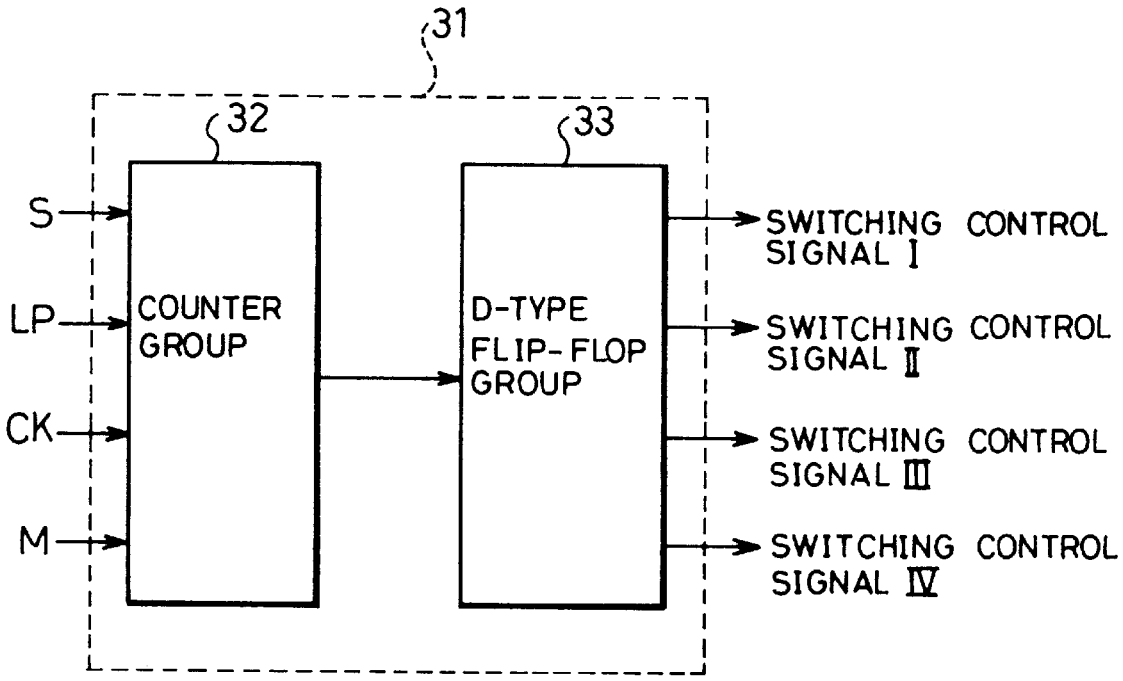
FIG. 3 is a schematic circuit diagram illustrating a switching control signal generating part, which is provided in a liquid crystal driving signal control section provided in the control circuit of the LCD apparatus shown in FIG. 1.

The switching signals I through IV are issued by a switching control signal generating circuit (switching control part) 31 including, for example, a counter group 32 and a D-type flip-flop group (signal generating part) 33, as shown in FIG. 3. The counter group 32 is supplied with a scanning signal S, a data latch signal LP, a data shift signal CK, and an AC conversion signal M from outside. The D-type flip-flop group 33 is supplied with a control signal in accordance with these signals, thereby outputting the switching control signals I through IV. Note that the switching control signal generating circuit 31 is provided in the liquid crystal driving signal control section 15.

Figure 5:
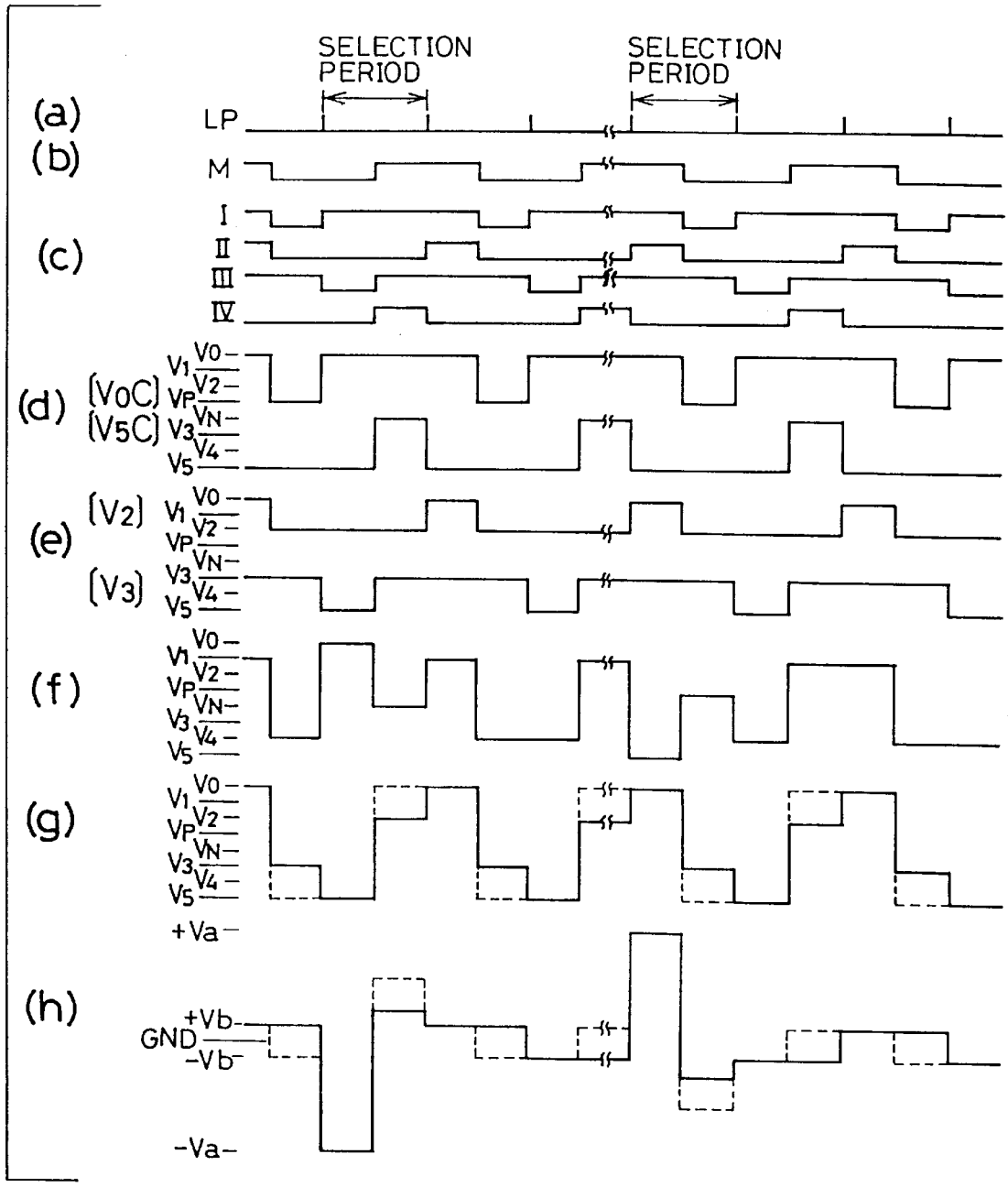
FIG. 5 is a view illustrating signal waveforms relating to the method for driving the LCD apparatus shown in FIG. 1.
Figure 6:
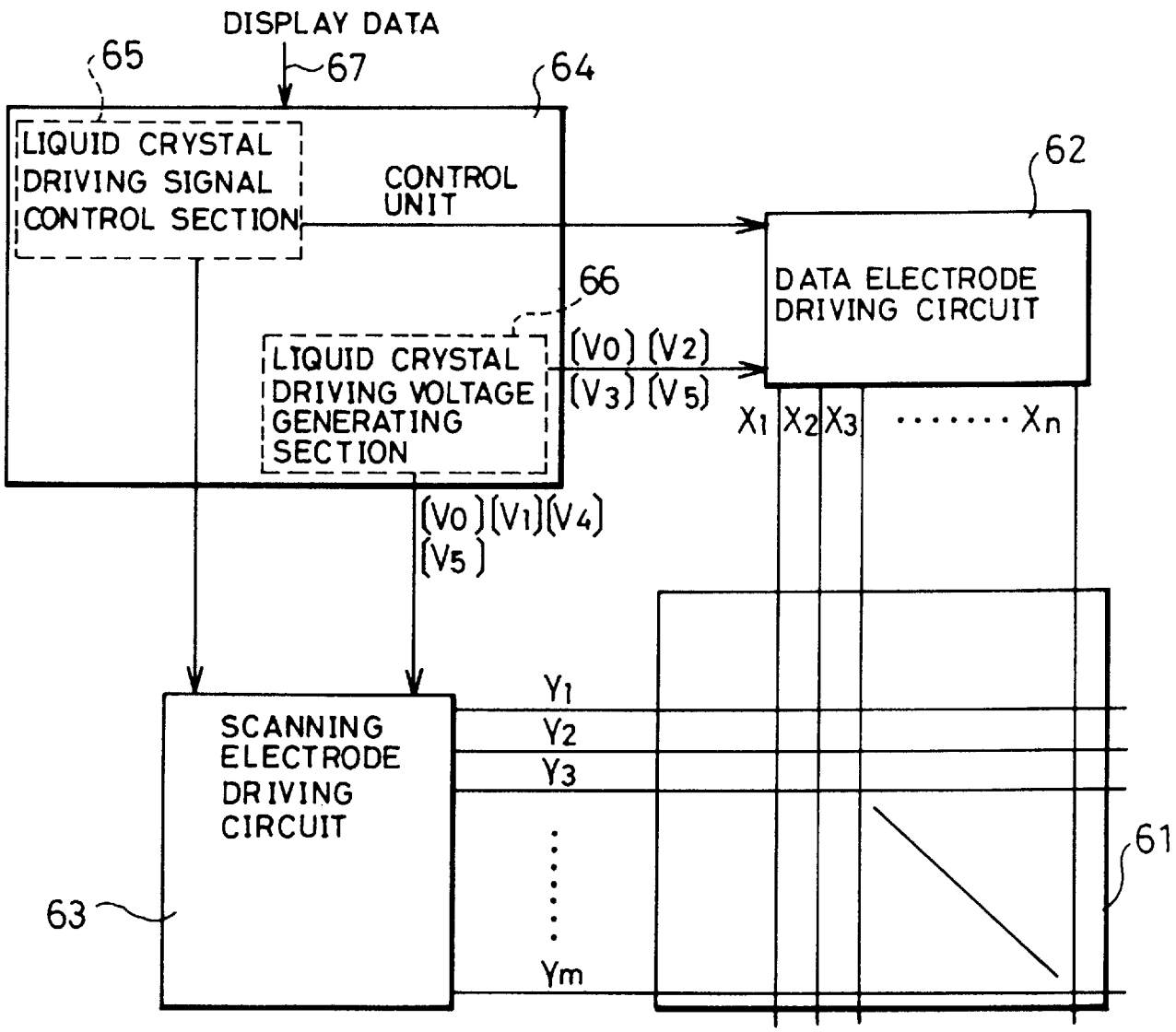
FIG. 6 PRIOR ART
FIG. 6 is a block diagram illustrating a schematic arrangement of an LCD apparatus to which a conventional method for driving an LCD apparatus is applied.

As shown in FIGS. 5(*a*), 5(*b*), and 5(*c*), the switching control signals I through IV are issued based on the AC conversion signal M, whose polarity is reversed at least once during one selection period which is determined by the data latch signal LP.

To be more specific, the switching control signal I is arranged as follows: when it is detected that an "L"-level period of the AC conversion signal M overlaps a latter half of a selection period, the switching control signal I has the "L" level during the same latter half of the selection period. The switching control signal I is thus arranged so as to switch the voltage supplied to the voltage applying line [$V_{0C}$] from $V_0$ to $V_P$, as shown in FIG. 5(*d*).

The switching control signal II is arranged as follows: when it is detected that an "H"-level period of the AC conversion signal M overlaps a first half of a selection period, the switching control signal II has the "H" level during the same first half of the selection period. The switching control signal II is thus arranged so as to switch the voltage supplied to the voltage applying line [$V_2$], as shown in FIG. 5(*e*).

The switching control signal III is arranged as follows: when it is detected that an "L"-level period of the AC conversion signal M overlaps a first half of a selection period, the switching control signal III has the "L" level during the same first half of the selection period. The switching control signal III is thus arranged so as to switch the voltage supplied to the voltage applying line [$V_3$], as shown in FIG. 5(*e*).

The switching control signal IV is arranged as follows: when it is detected that an "H"-level period of the AC conversion signal M overlaps a latter half of a selection period, the switching control signal IV has the "H"-level during the same latter half of the selection period. The switching control signal IV is thus arranged so as to switch the voltage supplied to the voltage applying line [$V_{5C}$], as shown in FIG. 5(*d*).

Therefore, the voltage switching part 27 switches the voltage supplied to the voltage applying line [$V_{0C}$] from the high power source electric potential $V_0$ of the liquid crystal driving power source voltage $V_{EE}$ to the electric potential $V_P$ supplied from the OP amplifier 21, or vice versa, in accordance with the switching control signal I inputted to the voltage switching part 27.

Likewise, the voltage switching part 28 switches the voltage supplied to the voltage applying line [$V_2$] from the high power source electric potential $V_0$ of the liquid crystal driving power source voltage $V_{EE}$ to the electric potential $V_2$ supplied from the OP amplifier 23, or vice versa, in accordance with the switching control signal II inputted to the voltage switching part 28.

The voltage switching part 29 also switches the voltage supplied to the voltage applying line [$V_3$] from the low power source electric potential $V_5$ of the liquid crystal driving power source voltage $V_{EE}$ to the electric potential $V_3$ supplied from the OP amplifier 24, or vice versa, in accordance with the switching control signal III inputted to the voltage switching part 29.

Likewise, the voltage switching part 30 also switches the voltage supplied to the voltage applying line [$V_{5C}$] from the low power source electric potential $V_5$ of the liquid crystal driving power source voltage $V_{EE}$ to the electric potential $V_N$ supplied from the OP amplifier 26, or vice versa, in accordance with the switching control signal IV inputted to the voltage switching part 30.

Note that supplied to the voltage applying line [$V_{0S}$] is the high power source electric potential $V_0$ of the liquid crystal driving power source voltage $V_{EE}$, while supplied to the voltage applying line [$V_{5S}$] is the low power source electric potential $V_5$ of the liquid crystal driving power source voltage $V_{EE}$. The electric potentials satisfy a relation given as:

$V_0>V_1>V_2>V_P>V_N>V_3>V_4>V_5$

Figure 4:
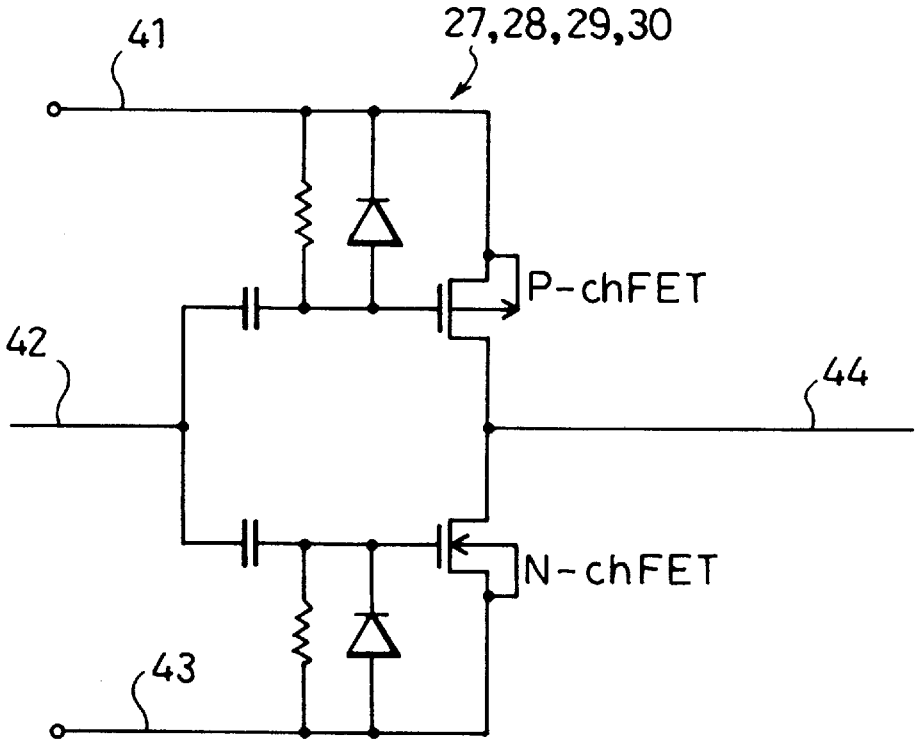
FIG. 4 is a schematic circuit diagram illustrating a voltage switching part provided in the liquid crystal driving voltage generating section shown in FIG. 2.

The following description will discuss a concrete structure of the voltage switching parts 27 through 30, with reference to FIG. 4. Note that the voltage switching parts 27 through 30 have the same structure.

As shown in FIG. 4, each of the voltage switching parts 27 through 30 includes two capacitors, two resistors, two diodes, a P-FET (P-channel field effect transistor), and an N-FET (N-channel field effect transistor), and includes a high potential side input line 41 for applying a high potential voltage, a low potential side input line 43 for applying a low potential voltage, a control signal input line 42 for inputting the switching control signals, and an output line 44 for outputting either a high potential voltage or a low potential voltage.

For example, in the voltage switching part 27, the voltage applying line [$V_{0C}$] is equivalent to the output line 44. The voltages $V_0$ and $V_P$ are applied to the high and low potential side input lines 41 and 43, respectively, and the switching control signal I is supplied to the control signal input line 42. Here, when the switching control signal I is at the "H" level, a voltage with the electric potential $V_0$ is applied to the voltage applying line [$V_{0C}$]. On the other hand, when the switching control signal I is at the "L" level, a voltage with the electric potential $V_P$ is applied to the voltage applying line [$V_{0C}$]. This is shown in FIG. 5(*d*). The other voltage switching parts 28 through 30 have the same switching system as the described system of the voltage switching part 27.

With the described arrangement, when the above electric potentials are supplied to the voltage applying lines [$V_{0C}$], [$V_1$], [$V_4$], and [$V_{5C}$], the scanning electrode driving circuit 12 has an output in a waveform shown in FIG. 5(*f*). Also when the above electric potentials are supplied to the voltage applying lines [$V_{0S}$], [$V_2$], [$V_3$], and [$V_{5S}$], the data electrode driving circuit 13 has an output in a waveform shown in FIG. 5(*g*).

Here, when a signal in the waveform shown in FIG. 5(*f*) is supplied from the scanning electrode driving circuit 12 to the scanning electrode line Y1 and a signal in the waveform shown in FIG. 5(*g*) are supplied from the data electrode driving circuit 13 to the data electrode line X1, a signal supplied to the liquid crystal element as a result is in a waveform shown in FIG. 5(*h*). Note that the solid line in FIG. 5(*h*) indicates that the liquid crystal element is in the "ON" state, while the broken line in the figure indicates that the liquid crystal element in the "OFF" state. Va is equal to the liquid crystal power source voltage $V_{EE}$, while $V_b$ is equal to the difference between the respective electric potentials.

Thus, according to the present invention, each selection period is divided into two, and each of the voltages applied to the scanning electrode driving circuit 12 and the data electrode driving circuit 13 has different levels in the first and latter halves of each selection period. As a result, each of the signals outputted by the scanning electrode driving circuit 12 and the data electrode driving circuit 13 is arranged so as to have different levels in the first and latter halves of the selection period. Therefore, by using the first half of the selection period for writing (writing period) while using the latter half of the selection period for erasing (erasing period), a voltage applied during the writing period in accordance with a difference signal is cancelled by a voltage applied during the erasing period. Therefore, the residual image phenomenon, or the burning phenomenon, stemming from the voltage applying time-dependency of the I-V characteristic of the two-terminal element 72, can be prevented. In short, the liquid crystal element 71 can be driven by the dividing-driving method, wherein the selection period is divided into plural division periods and voltages at different levels are applied during the periods, respectively.

According to the above arrangement, controlling the voltage applied to the liquid crystal element 71 in one selection period is enabled by adjusting the waveforms of the signals outputted by the scanning electrode driving circuit 12 and the data electrode driving circuit 13. Therefore, in order to control the voltage applied to the liquid crystal element 71 in one selection period, it is required to control the waveforms of the signals outputted by the scanning electrode driving circuit 12 and by the data electrode driving circuit 13 as follows: as is the case with the liquid crystal driving voltage generating section 16 shown in FIG. 2, (1) among the voltages applied to the scanning electrode driving circuit 12, the voltages which are supplied to both the scanning electrode driving circuit 12 and the data electrode driving circuit 13 are switched from the voltages $V_0$ and $V_5$ to the voltages $V_P$ and $V_N$, respectively, or vice versa, at fixed timings, the voltages $V_P$ and $V_N$ having different levels from those of the voltages $V_0$ and $V_5$, respectively, and (2) the voltages supplied only to the data electrode driving circuit 13 are switched from the voltages $V_2$ and $V_3$ to the voltages $V_0$ and $V_5$, respectively, or vice versa, at fixed timings, the voltages $V_2$ and $V_3$ having different levels from those of the voltages $V_0$ and $V_5$, respectively. Note that the switching timings are determined in accordance with the switching control signals I through IV.

Moreover, since the adjustment of the waveform of the difference signal in accordance with the difference between the scanning signal and the data signal is carried out by switching the levels of the voltages inputted to the driving circuits, it is possible to utilize conventional driving circuits without any revision. In other words, the dividing-driving method, which is effectual against the residual image phenomenon, or the burning phenomenon, of LCD apparatuses employing two-terminal elements, can be carried out with driving circuits provided in conventional LCD apparatuses of the passive type. As a result, the dividing-driving method can be adopted to driving circuits (drivers) driven by the voltage averaging method, which has been adopted to the conventional LCD apparatuses of the passive type.

Thus, there is no need to develop new dividing-driving method-use drivers of LCD apparatuses since conventional drivers can be utilized, thereby suppressing rise of cost and possibly reducing a period required for developing new-type LCD apparatuses.

Note that though in the present embodiment each selection period is divided into two, this may be varied in many ways. Each period may be divided into not less than three. In such a case, the number of the voltage switching parts may be increased in accordance with the number of divisions.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. The method for driving a liquid crystal display apparatus, the liquid crystal display apparatus comprising a scanning electrode group having scanning electrodes, a data electrode group having data electrodes, and pairs of liquid crystal elements and two-terminal non-linear elements connected with each other in a series, each intersection of the scanning electrodes and the data electrodes having one of the pairs, the method comprising the steps of:

(a) switching levels of driving voltages in first and second driving voltage groups at respective fixed timings for each of at least two division periods, said at least two division periods constituting one selection period in which one of the scanning electrodes in the scanning electrode group is selected, a combination of the driving voltages in the second driving voltage group being different from that of the first driving voltage group;

(b) generating a scanning signal and a data signal, the scanning signal being generated by a scanning electrode driving circuit in accordance with the first driving voltage group and applied to the scanning electrode in a line-sequential manner so that one of the scanning electrodes is selected during each selection period, the data signal being generated by a data electrode driving circuit in accordance with the second driving voltage group and applied to each data electrode of the data electrode group; and (c) applying the scanning signal to the selected scanning electrode while applying the data signal to the data electrode group, so as to drive the liguid crystal elements, connected between the selected scanning electrode and the data electrodes, through the two-terminal non-linear elements of the respective pairs, wherein the step (a) comprises the steps of:

switching levels of driving voltages in the first driving voltage group so that only level of the driving voltages which are commonly included in the first and second driving voltage groups are switched; and switching levels of the driving voltages in the second driving voltage group except those which are commonly included in the first and second driving groups.

2. The method as set forth in claim 1, wherein, in the step (a), each selection period is divided into two division periods, a first two driving voltages are included commonly in the first and second driving voltage groups, and one level of the first two driving voltages is switched in the latter half division period of the selection period, and a second two driving voltages are exclusively included in the second driving voltage group and one of the second two driving voltages is switched in the former half division period of the selection period.

3. A liquid crystal display apparatus comprising:

a scanning electrode group having scanning electrodes, a data electrode group having data electrodes, and pairs of liquid crystal elements and two terminal non-linear elements connected with each other in series, each intersection of the scanning electrodes and the data electrodes having one of the pairs;

a scanning electrode driving circuit for generating a scanning signal in accordance with a first driving voltage group composed of a plurality of driving voltages, the scanning signal being applied to the scanning electrode so that one of the scanning electrodes is selected one by one for each selection period;

a data electrode driving circuit for generating a data signal to be applied to each data electrode, the data signal being generated in accordance with a second driving voltage group composed of a plurality of driving voltages, a combination of the driving voltages of the second driving voltage group being different from that of the first driving voltage group;

a control circuit for switching levels of the driving voltages of the first and second driving voltage groups, at respective fixed timings for each of at least two division periods, the at least two division periods constituting one selection period;

a switching control section for generating a switching control signal; and a driving voltage generating section for generating the driving voltages of the first and second driving voltage groups and for switching the levels of the driving voltages in response to the switching control signal, wherein said driving voltage generating section includes a voltage switching section for switching levels of driving voltages in the first driving voltage group so that only the levels of the driving voltages included in both the first and second driving voltage groups are switched, and for switching levels of the driving voltages in the second driving voltage group except those included commonly in the first and second driving groups.

4. The liquid crystal display apparatus as set forth in claim 3, wherein so as to switch two driving voltages, said voltage switching section includes:

a P-channel field effect transistor for outputting one of the driving voltages when shifting to an ON state in response to the switching control signal of a high level; and an N-channel field effect transistor for outputting another driving voltage when shifting to an ON state in response to the switching control signal of a low level.

5. A device for driving a liquid crystal display apparatus, the liquid crystal display apparatus comprising a scanning electrode group having scanning electrodes, a data electrode group having data electrodes, and pairs of liquid crystal elements and two-terminal non-linear elements connected with each other in series, each intersection of the scanning electrodes and the data electrodes having one of the pairs, the device comprising:

means for switching levels of driving voltages in first and second driving voltage groups at respective fixed timings for each of at least two division periods, said at least two division periods constituting one selection period in which one of the scanning electrodes in the scanning electrode group is selected, a combination of the driving voltages in the second driving voltage group being different from that of the first driving voltage group;

means for generating a scanning signal and a data signal, the scanning signal being generated by a scanning electrode driving circuit in accordance with the first driving voltage group and applied to the scanning electrode in a line-sequential manner so that one of the scanning electrodes is selected during each selection period, the data signal being generated by a data electrode driving circuit in accordance with the second driving voltage group and applied to each data electrode of the data electrode group; and means for applying the scanning signal to the selected scanning electrode while applying the data signal to the data electrode group, so as to drive the liquid crystal elements, connected between the selected scanning electrode and the data electrodes, through the two-terminal non-linear elements of the respective pairs, wherein the means for switching comprises:

first means for switching levels of driving voltages in the first driving voltage group so that only the levels of the driving voltages which are commonly included in the first and second driving voltage groups are switched; and second means for switching levels of the driving voltages in the second driving voltage group except those which are commonly included in the first and second driving groups.

6. The device as set forth in claim 5, wherein each selection period is divided into two division periods, a first two driving voltages are included commonly in the first and second driving voltage groups, and one level of the first two driving voltages is switched in the latter half division period of the selection period, and a second two driving voltages are exclusively included in the second driving voltage group and one of the second two driving voltages is switched in the former half division period of the selection period.

* * * * *